United States Patent [19]

Knowlton

[11] 4,308,076

[45] Dec. 29, 1981

[54] METHOD FOR CLEANING HEAT EXCHANGERS IN SITU

[75] Inventor: Harold E. Knowlton, Moraga, Calif.

[73] Assignee: Chevron Research Company, San Francisco, Calif.

[21] Appl. No.: 177,041

[22] Filed: Aug. 11, 1980

Related U.S. Application Data

[63] Continuation-in-part of Ser. No. 138,820, Apr. 9, 1980, abandoned.

[51] Int. Cl.[3] ..... B08B 3/08; B08B 9/00

[52] U.S. Cl. ..... 134/10; 134/22 R; 165/95

[58] Field of Search ..... 134/2, 10, 22 R, 22 C; 165/95; 55/73

[56] References Cited

U.S. PATENT DOCUMENTS

| | | | |
|---|---|---|---|
| 1,049,054 | 12/1912 | Coombs | 134/22 C |
| 4,033,407 | 7/1977 | Quintilliano | 165/95 |
| 4,143,702 | 3/1979 | Barr | 134/22 C X |
| 4,155,988 | 5/1979 | Karwat et al. | 55/73 X |

*Primary Examiner*—Marc L. Caroff

*Attorney, Agent, or Firm*—D. A. Newell; W. D. Reese; J. W. Ambrosius

[57] ABSTRACT

A feed-effluent heat exchanger in a sour water stripping system having sour water stripping means, sour water storage means, and a stripper feed-effluent heat exchanger, is cleaned when the stripped water pathway in the heat exchanger becomes fouled, by passing sour water having a pH of greater than 8 from the storage means through the stripped water pathway in the exchanger at a temperature of at least 70° F., and returning the sour water to the sour water storage means.

3 Claims, 1 Drawing Figure

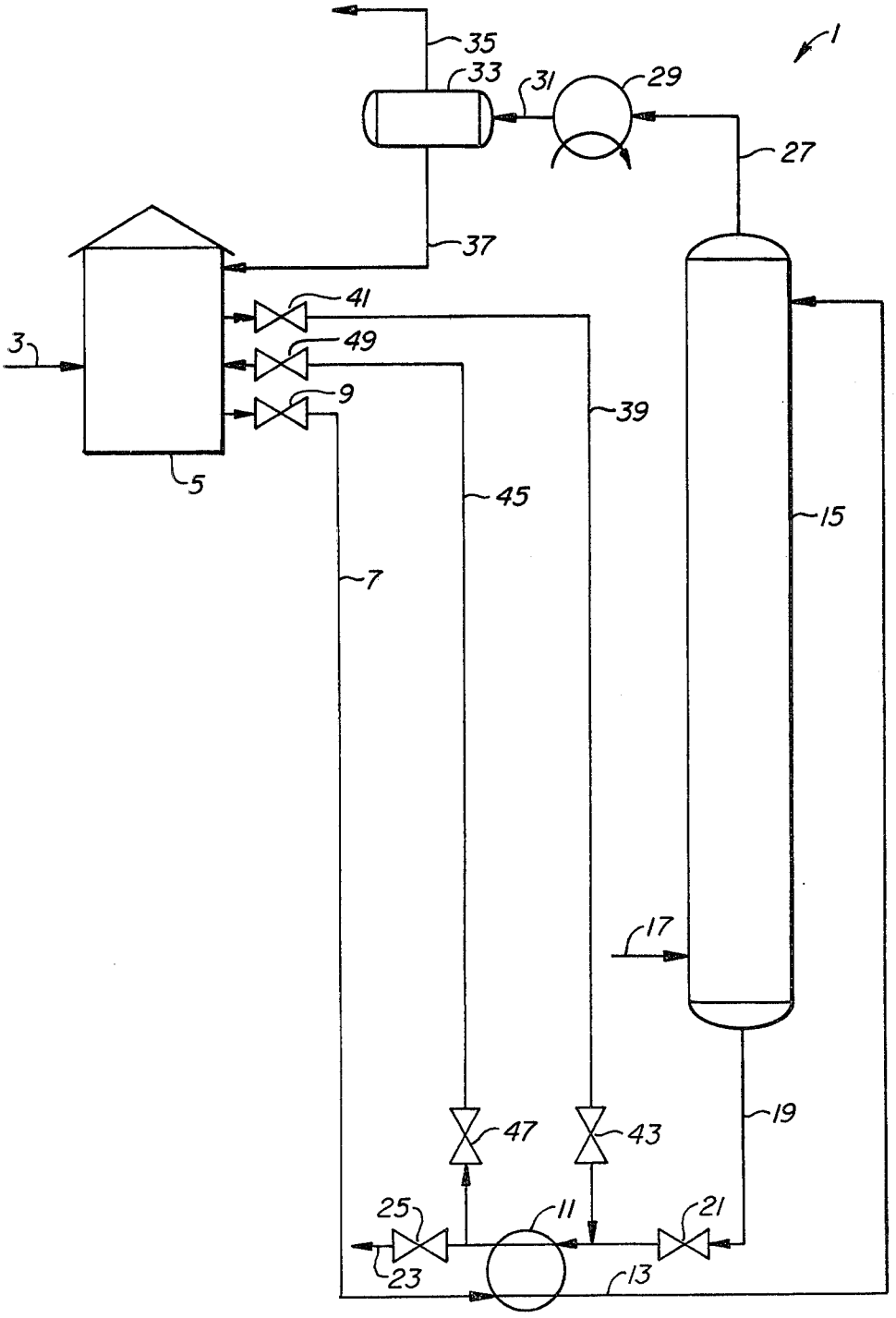
1
35
33
31
29
27
37
41
3
49
9
39
5
45
15
7
17
19
47
43
25
11
21
23
13

METHOD FOR CLEANING HEAT EXCHANGERS IN SITU

CROSS-REFERENCE TO RELATED APPLICATIONS

This application is a continuation-in-part of my copending application Ser. No. 138,820, filed on Apr. 9, 1980, now abandoned, the disclosure of which is incorporated herein by specific reference.

BACKGROUND OF THE INVENTION

The present invention concerns a method for cleaning heat exchangers. More specifically, the present invention concerns an in-situ method for cleaning a feed-effluent heat exchanger in a system for stripping sour water to purify the water.

Water and steam are used extensively in petroleum refining operations. During use, the water and steam often come in contact with ammonia, cyanide and so-called "acid gases" such as hydrogen sulfide and carbon dioxide. Such contaminant materials dissolve fairly readily in water, and in condensing steam, and refinery processing water streams thereby often becomes seriously contaminated. The contaminated water is commonly called "sour water".

Sour water is usually unsuitable for use in refining operations or in steam generations, and is considered a waste material. It is not desirable to discharge large amounts of sour water into normal waste disposal systems because of the high pollutant content. Therefore, various purifications systems are conventionally employed to remove the pollutants and permit the water to be used further in refining operations.

A common conventional method for removing the contaminants from sour water is by treating the contaminated water in a sour water stripper. Typically, a sour water stripper includes means for stripping the water, means for storing the sour water feed, and a feed-effluent heat exchanger which is employed to minimize the heat input necessary for carrying out the stripping operation. Stripping means employed in conventional systems usually include a distillation column, in which the sour water is passed downwardly in countercurrent flow to a hot gas, such as steam, flue gas or natural gas. The sour water storage means employed in most operations is typically a sump or surge vessel to insure a steady supply of feed to the stripper. Not uncommonly, the sour water storage facility may be a large capacity storage vessel, in which several days' supply of water can be stored if necessary. Of course, the stripping system normally includes other conventional components, such as an overhead condensing system for treating the steam and contaminants removed overhead from the stripping column, pumping means, controlling means, etc., and the stripping column is normally equipped with internals to facilitate contact between the stripping gas and water, such as trays, baffles, or the like. In a steam-stripping system, sour water enters the top of the distillation column and stripped, purified water is removed from the bottom of the column. Steam enters the bottom of the column and steam, hydrogen sulfide and ammonia, etc., are removed from the top of the column. The steam is condensed and the hydrogen sulfide and ammonia are recovered as gases for further treatment. Since the condensed steam is usually contaminated with a substantial amount of hydrogen sulfide and ammonia, it is usually returned to the sour water storage facilities for recycling to the stripper.

In a feed-effluent heat exchanger, the hot stripped water effluent recovered from the bottom of the stripping column is heat exchanged with the cooler sour water feed, which is then fed to the top of the column. It has been found that the stripped water pathway in the feed-effluent exchanger can become seriously and rapidly fouled during the heat exchanging operation, typically due to the deposition of elemental sulfur on the surfaces in the heat exchanger. Cleaning the stripped water side of a feed effluent exchanger by conventional mechanical means is a tedious and time-consuming procedure. The present invention is directed, in part, at providing a means for cleaning the stripped water pathway in a feed-effluent heat exchanger without the use of extraneous mechanical equipment, expensive chemical cleaners or the like.

SUMMARY OF THE INVENTION

I have found that the fouling deposits which are formed in the stripped water pathway in feed-effluent heat exchangers used in sour water stripping systems can conveniently and efficiently be removed by simply passing sour water having a pH of greater than 8 through the stripped water passageway in the heat exchanger at a temperature of at least 70° F., preferably at least 130° F. Particularly conveniently, the sour water used for cleaning a feed-effluent exchanger can simply be withdrawn from the storage or surge vessel used in the system and passed into the heat exchanger and then returned to the sour water storage vessel.

DESCRIPTION OF THE DRAWING

The attached drawing is a schematic representation of the preferred embodiment of the method of the present invention.

DETAILED DESCRIPTION OF THE INVENTION

As used herein, the term "sour water" refers to water containing hydrogen sulfide and/or ammonia in concentrations sufficient to make the water unsuitable for use without stripping.

As used herein, the term "stripped water pathway" refers to the conduits, chambers, ducts, pipes, tubes, shell, or the like, through which stripped water is normally passed in a feed-effluent heat exchanger. For example, in a shell and tube type heat exchanger, the stripped water pathway is either through the tube system or through the shell system around the tubes.

PREFERRED EMBODIMENTS

The invention can best be described further by reference to the preferred embodiments illustrated in the attached drawing. It will be understood, however, that the scope of the invention is not limited to the specific embodiments depicted, and that the scope of the invention includes alternatives, modifications and equivalents of the depicted embodiment which are within the scope of the appended claims, and which will be readily apparent to those skilled in the art.

Referring to the drawing, there is shown a steam-stripping system 1. Sour water from refinery operations is introduced into the system through conduit 3 and is passed into a surge or storage vessel 5. The surge or storage vessel 5 may simply be a sump for providing a constant feed to the stripping system or may be a more substantial storage vessel for storing large amounts of sour water. During normal operation of the system, sour water is passed from the storage vessel 5 through a conduit 7 equipped with a normally open valve 9. The sour water is passed through the feed-effluent heat exchanger 11 and is then passed through a conduit 13 into the top of a steam stripping column 15. Steam for stripping contaminants from the water is introduced into the bottom of the column 15 to a conduit 17. The steam employed may conveniently be of low quality and also may be contaminated with hydrogen sulfide, ammonia and the like. Stripped, purified water is withdrawn from the bottom of the column 15 through a conduit 19, which is equipped with a normally open valve 21. The stripped water is then introduced into the feed-effluent exchanger and heat exchanged with the sour water feed to cool the effluent and heat the feed. Cooled, stripped water is then removed from the heat exchanger 11 and recovered from a system by way of a conduit 23, which is equipped with a normally open valve 25. Steam, carrying with it the stripped hydrogen sulfide, ammonia, and any other volatile contaminants from the sour water, is removed from the top of the column 15 and passed through a conduit 27 into a partial condenser 29, in which the steam is condensed. The resulting mixture of liquid water, gaseous hydrogen sulfide, ammonia, etc., is passed from the condenser 29 through a conduit 31 into a separator 33. Gases are withdrawn from the top of the vessel 33 through a conduit 35 and are discharged from the system. Disposal or use of these gases will, of course, depend upon the gas treatment and the recovery facilities available in a particular refinery operation. Water is withdrawn from the bottom of the vessel 33 and is passed into storage vessel 5 through a conduit 37, as it is normally quite contaminated with dissolved hydrogen sulfide and ammonia. According to one preferred embodiment of the present invention, when the stripped water pathway in the heat exchanger 11 becomes fouled with solid deposits of such materials as elemental sulfur, the valves 9, 21 and 23 are closed. Sour water having a pH of greater than 8, is withdrawn from the storage vessel 5, and is then passed through a conduit 39, which is equipped with normally closed valves 41 and 43. The pH of the sour water passed into the conduit 39 can be adjusted as necessary in a conventional manner, as by addition of caustic, preferably after the water is withdrawn from the sour water storage vessel, in order to avoid the use of excessive amounts of chemicals. The valves 41 and 43 are closed during normal stripping operation of the system, and are only open during the heat exchanger cleaning operation. The sour water in the conduit 39 flows into the conduit 19 and through the stripped water path in the heat exchanger 11. The temperature of the sour water used to clean a stripped water side of the exchanger is at least 70° F., and preferably at least 130° F. Means (not shown) may be employed for heating the sour water prior to introducing it into the stripped water side of the heat exchanger in order to facilitate the rapidity of the cleaning operation. After use in cleaning the heat exchanger 11, the sour water stream is then removed from heat exchanger through the conduit 23 and is passed through a conduit 45, equipped with normally closed valves 47 and 49, into the storage vessel 5. The valves 47 and 49 are kept closed during normal stripping operation of the system, and are only open during the heat exchanger cleaning operation.

The length of time used for carrying out the sour water treatment of the invention for cleaning a feed-effluent heat exchanger will, of course, depend upon the degree to which a particular heat exchanger has been fouled by deposits and the temperature of the sour water used for cleaning. Usually, adequate cleaning can be obtained by a treatment lasting for at least about 8 hours of sour water circulation. Preferably, the sour water cleaning treatment is carried out for at least 12 hours. If the temperature of the sour water is substantially above 70° F., the treatment can be relatively shorter. The treatment temperature will usually depend upon heating means available. If temperature of the sour water used for cleaning can be kept above 130° F., but preferably below 140° F., then substantially shorter cleaning periods can conveniently be employed.

Another preferred embodiment of the in-situ cleaning method can be carried out by decreasing or discontinuing introduction of stripping steam into the vessel 15 and reducing the temperature of the liquid bottoms effluent from the stripping vessel 15 sufficiently to assure that ammonia and hydrogen sulfide remain in solution in the sour water bottoms in the vessel 15. The valves 9 and 21 are opened and the valves 41 and 43 are closed in this mode of carrying out the cleaning operation. Sour water flows through the conduit 13, the vessel 15 and the conduit 19 into the stripped water pathway in the heat exchanger 11. The valve 25 is closed, and the valves 47 and 49 are opened, so that the sour water returns to the storage vessel 5 through the conduit 45. Passing the sour water through the vessel 15 without stripping permits the normal bottoms heating system in the stripping operation to be used for heating the sour water used for cleaning the heat exchanger.

Various necessary, conventional elements of the steam-stripping system used in the preferred embodiments of the invention described above, such as valve means, pumping means and controlling means, are not shown in the drawing or described. Their use and placement in the system will be apparent to those skilled in the art.

Preferred embodiments of the present invention having been described, numerous variations and modifications of the invention will be apparent to those skilled in the art, such obvious modifications and equivalents are intended within the scope of the appended claims.

What is claimed is:

1. In a method for cleaning stripped water pathway surfaces fouled with elemental sulfur deposits in a heat exchanger of a sour water stripping system including sour water stripping means, sour water storage means, and said heat exchanger for transferring heat from stripped water removed from said stripping means to sour water to be fed to said stripping means, the improvement comprising:

passing sour water having a pH of greater than 8 from said storage means through said stripped water pathway in said exchanger at a temperature of at least 70° F., and returning said sour water to said storage means.

2. The method of claim 1 wherein sour water is passed through said heat exchanger at a temperature of at least 130° F.

3. The method of claim 1 wherein sour water is passed through said stripping means without stripping ammonia and hydrogen sulfide from said sour water prior to passing through said heat exchanger.

* * * * *